US007815771B2

(12) United States Patent
Faucher et al.

(10) Patent No.: US 7,815,771 B2
(45) Date of Patent: Oct. 19, 2010

(54) PROCESS FOR THE MANUFACTURE OF PAPER AND BOARD

(75) Inventors: Gatien Faucher, Saint Etienne (FR); Rene Hund, Villars (FR); Christian Jehn-Rendu, Saint Just Saint Rambert (FR)

(73) Assignee: SNF S.A.S., Saint Etienne (FR)

( * ) Notice: Subject to any disclaimer, the term of this patent is extended or adjusted under 35 U.S.C. 154(b) by 546 days.

(21) Appl. No.: 11/568,063

(22) PCT Filed: Nov. 8, 2004

(86) PCT No.: PCT/FR2004/050572

§ 371 (c)(1),
(2), (4) Date: Oct. 18, 2006

(87) PCT Pub. No.: WO2005/116336

PCT Pub. Date: Dec. 8, 2005

(65) Prior Publication Data

US 2009/0050282 A1 Feb. 26, 2009

(30) Foreign Application Priority Data

Apr. 29, 2004 (FR) ..... 04 04582
Jul. 12, 2004 (FR) ..... 04 51503

(51) Int. Cl.
*D21H 21/10* (2006.01)

(52) U.S. Cl. ..... 162/158; 162/164.1; 162/168.1; 162/168.3; 162/181.2; 162/181.8; 162/181.6; 162/183

(58) Field of Classification Search ..... 162/158, 162/164.1, 164.3, 164.5–164.6, 166, 168–168.3, 162/181.1, 181.6, 181.8, 183, 181.2
See application file for complete search history.

(56) References Cited

U.S. PATENT DOCUMENTS

| | | | | |
|---|---|---|---|---|
| 3,052,595 | A | 9/1962 | Pye | |
| 4,913,775 | A * | 4/1990 | Langley et al. | 162/164.3 |
| 5,180,473 | A * | 1/1993 | Akune et al. | 162/168.2 |
| 5,232,553 | A * | 8/1993 | Smigo et al. | 162/147 |
| 5,274,055 | A * | 12/1993 | Honig et al. | 524/47 |
| 5,393,381 | A * | 2/1995 | Hund et al. | 162/168.3 |
| 5,571,379 | A * | 11/1996 | Derrick | 162/168.1 |
| 5,676,796 | A * | 10/1997 | Cutts | 162/158 |
| 5,876,563 | A * | 3/1999 | Greenwood | 162/175 |
| 5,902,455 | A * | 5/1999 | Hund et al. | 162/164.1 |
| 6,406,593 | B1 * | 6/2002 | Heard et al. | 162/168.1 |
| 6,579,417 | B1 * | 6/2003 | Hund et al. | 162/164.1 |
| 6,797,785 | B1 * | 9/2004 | Hund et al. | 525/328.2 |
| 2003/0150575 | A1 * | 8/2003 | Hund et al. | 162/168.3 |
| 2004/0030039 | A1 * | 2/2004 | Hund et al. | 524/800 |
| 2004/0040683 | A1 * | 3/2004 | Hund et al. | 162/164.1 |
| 2004/0102528 | A1 * | 5/2004 | Walchuk et al. | 516/20 |
| 2004/0143039 | A1 * | 7/2004 | Hollomon et al. | 524/35 |
| 2004/0149407 | A1 * | 8/2004 | Chen et al. | 162/158 |
| 2005/0061462 | A1 * | 3/2005 | Johansson-Vestin et al. | 162/158 |
| 2005/0236123 | A1 * | 10/2005 | McNamara et al. | 162/158 |
| 2006/0243407 | A1 * | 11/2006 | Hund et al. | 162/158 |
| 2007/0110699 | A1 * | 5/2007 | Sherry | 424/70.17 |
| 2007/0119560 | A1 * | 5/2007 | Birkert et al. | 162/158 |
| 2007/0265358 | A1 * | 11/2007 | Walchuk et al. | 516/27 |
| 2008/0066880 | A1 * | 3/2008 | Polverari et al. | 162/158 |
| 2008/0128102 | A1 * | 6/2008 | Polverari et al. | 162/168.3 |
| 2008/0156448 | A1 * | 7/2008 | Hund et al. | 162/164.6 |
| 2008/0196851 | A1 * | 8/2008 | Hund et al. | 162/164.6 |
| 2009/0025891 | A1 * | 1/2009 | Wong Shing et al. | 162/5 |
| 2009/0050282 | A1 * | 2/2009 | Faucher et al. | 162/164.5 |
| 2009/0277597 | A1 * | 11/2009 | Hund et al. | 162/164.3 |

FOREIGN PATENT DOCUMENTS

| | | | |
|---|---|---|---|
| EP | 0 235 893 | | 9/1987 |
| EP | 0 374 458 | | 6/1990 |
| EP | 0 462 365 | | 12/1991 |
| EP | 1 167 392 | | 1/2002 |
| EP | 1328683 | B1 | 7/2003 |
| FR | 2869625 | A1 * | 11/2005 |
| FR | 2882373 | A1 * | 8/2006 |
| WO | WO 95/33097 | | 12/1995 |
| WO | WO 9716598 | A1 * | 5/1997 |
| WO | WO 98/29604 | | 7/1998 |
| WO | WO 9961702 | A1 * | 12/1999 |
| WO | WO 9963159 | A1 * | 12/1999 |
| WO | WO 9966130 | A1 * | 12/1999 |
| WO | WO 01/34908 | | 5/2001 |
| WO | WO 01/34909 | | 5/2001 |
| WO | WO 0134908 | A1 * | 5/2001 |
| WO | WO 0134909 | A1 * | 5/2001 |
| WO | WO 02/33171 | | 4/2002 |
| WO | WO 2005116336 | A1 * | 12/2005 |
| WO | WO 2006064139 | A1 * | 6/2006 |
| WO | WO 2006075115 | A2 * | 7/2006 |
| WO | WO 2006090076 | A1 * | 8/2006 |

* cited by examiner

*Primary Examiner*—José A Fortuna
(74) *Attorney, Agent, or Firm*—Heslin Rothenberg Farley & Mesiti P.C.

(57) ABSTRACT

A process for the manufacture of paper, board or similar products, comprises first of all, adding, to the paper pulp fibrous suspension, at least one main retention aid composed of a cationic (co)polymer.

Then optionally the flocs obtained are sheared.

Subsequently there is added to the suspension, separately or as a mixture, in any order:

at least one secondary retention aid chosen from the group consisting of silica derivatives and anionic or amphoteric organic polymers, and at least one tertiary retention aid composed of a crosslinked anionic organic polymer with a size of greater than or equal to 1 micrometer and exhibiting an intrinsic viscosity of less than 3 dl/g.

21 Claims, No Drawings

PROCESS FOR THE MANUFACTURE OF PAPER AND BOARD

Cross Reference to Related Applications

This is a Section 371 filing of international application No. PCT/FR2004/050572 filed Nov. 8, 2004, and published, in French, as International Publication No. WO 2005/116336 on Dec. 8, 2005, and claims priority of French Patent Application No. 0404582 filed Apr. 29, 2004 and French Patent Application No. 0451503 filed on Jul. 12, 2004, all of which applications are hereby incorporated by reference herein, in their entirety.

Background Art

The invention relates to a process for the manufacture of paper, board or similar products employing at least three retention and draining aids, respectively a main aid, one, indeed even two, secondary aids and a tertiary aid. Another subject-matter of the invention is the paper or board obtained by this process. Finally, it relates to the use of specific crosslinked anionic organic polymers as tertiary retention aid.

Retention systems of microparticulate type are well known in the process for the manufacture of paper. Their function is improve the retention, the drainage and the formation during the manufacture of the sheet.

The following are known in the prior art:

- Patent U.S. Pat. No. 3,052,595, where it is proposed to combine bentonite (inorganic microparticle) with a linear polyacrylamide (main retention aid),
- Patent EP-A-235 893, which discloses the addition of a cationic polymer of high molecular weight (main retention aid), then a shearing stage, then the addition of bentonite (secondary retention aid). According to this patent, the polymer has to be essentially linear (without intentional addition of branching aid),
- Patent U.S. Pat. No. 5,180,473 and the article by Watanabe et al. (Pulp Gijitsu Times, March 1989, pages 17 to 21) relate to the use, in a system of "dual" type, of a polymer (main retention aid) and then of an organic microparticle (secondary retention aid). It is specified (column. 3, 1. 65) that the microparticles (anionic or cationic) have to have a size which is as uniform as possible and as fine as possible.

It may be pointed out that, as this is the case for retention systems using inorganic microparticles, a person skilled in the art has known since 1989 that the size of organic microparticles is a direct indication of the capability for particulate agglomeration and thus for retention (by making it possible in particular to increase the availability of anionic or cationic charged sites).

Following the teaching of Watanabe, the following documents were subsequently published:

- Patent EP-A-462 365, which itself also relates to the use of a polymer (main retention aid) and of an organic microparticles (secondary retention aid), characterized in that the mean size of the microparticle has to be less than 750 nm,
- the document WO 02/33171 provides, in the same tradition as the abovementioned patent (p. 7, 1. 16+), for the joint use, in addition to the cationic organic polymer (main retention aid), of an inorganic particle (secondary retention aid) and of an anionic organic particle (tertiary retention aid) which has to have a size of less than 750 nm. This is a triple system, that is to say a system in which there are three types of retention aid,

- the document WO 98/29604 discloses the use of a cationic polymer (main retention aid) followed by a branched anionic organic polymer which is completely soluble in water and which exhibits an IV of greater than 3 dl/g (secondary retention aid). According to this document, the use of a branched anionic polymer as secondary retention aid, instead of a linear polymer, would make it possible to improve both the formation and the retention of the sheet. In addition, this document and the division EP-B-1 167 392 distinguish the notion of branched polymer and that of crosslinked polymer. Thus, and taking into consideration the teachings of the document EP-A-374 458, a polymer obtained by reverse phase polymerization of a water-soluble anionic monomer in the presence of a crosslinking aid, the level of which is between approximately 6 and 25 molar ppm, in the absence of transfer agent, is necessarily crosslinked. As emerges from the document EP-B-1 167 392, this thus means that, at a level of crosslinking aid of less than 6 molar ppm and in the absence of transfer agent, the anionic polymer obtained is branched, whereas, in the range from 6 to 25 molar ppm, the presence of transfer agent is necessary to obtain a branched polymer. It follows that, for higher levels of crosslinking aid, the polymer is necessarily crosslinked if there is no transfer agent. Another criterion which makes it possible to distinguish the two branched/crosslinked notions would be the calculation of the tangent delta, the parameter described in these documents. In practice, the polymers having a tangent delta of less than 0.7 are crosslinked, whereas they are branched in the opposite case. Thus, the polymers disclosed in particular in Examples 57A to 59A of the document EP-A-374 458, obtained in the presence of 6.9, 11.6 and 23.2 molar ppm respectively of crosslinking aid and in the absence of transfer agent, for which the tangent delta is equal to 0.54, 0.32 and 0.51 respectively, correspond in reality to polymers which are incompletely soluble in water, that is to say crosslinked polymers. It is also envisaged, in the document WO 98/29604, to use the secondary retention aid in the form of a mixture of anionic polymers. On such an assumption, either each of the polymers reproduces the characteristics of the specific anionic polymer (branched, completely soluble in water, viscosity of greater than 3 dl/g and tangent delta greater than 0.7) or the overall mixture reproduces these characteristics. On the latter assumption, it is very clear that a mixture which is branched overall can only comprise at the very least branched polymers and at the very most a mixture of branched polymers and of linear polymers, which thereby means that a mixture of crosslinked polymers with linear polymers cannot result in the production of a branched mixture,
- the documents EP-A-1 228 273 and WO 01/34909 disclose systems similar to that mentioned in the document EP-A-950 138, apart from the fact that they are triple systems. More specifically, provision is made for the introduction of bentonite or a siliceous material, before or after the anionic polymer.

The Applicant has found that the use of a crosslinked polymer of standard size as retention aid, optionally as a mixture with an anionic or amphoteric polymer, in place of the other organic polymers of the prior art, gives very good results, at least in terms of formation but also and in some cases in terms of retention and of drainage.

A subject-matter of the invention is thus a process for the manufacture of paper, board or similar products, which consist:

first of all in adding, to the fibrous suspension, at least one main retention aid composed of a cationic (co)polymer, then optionally in shearing the flocs obtained, the process being characterized in that the following are subsequently added to the suspension, separately or as a mixture, in any order:

at least one secondary retention aid chosen from the group consisting of silica derivatives and anionic or amphoteric organic polymers, at least one tertiary retention aid composed of a crosslinked anionic organic polymer with a size of greater than or equal to 1 micrometer and exhibiting an intrinsic viscosity of less than 3 dl/g.

As may be observed on reading the prior art, a person skilled in the art has for a long time been entirely dissuaded from using, as secondary retention aid, a compound with a large size and/or low specific surface, as these characteristics are associated with a low capability for agglomeration.

A person skilled in the art was dissuaded from using polymers of low molecular weight (low intrinsic viscosity) as the latter are known to exhibit poor performances in terms of retention and of drainage.

Because of this knowledge, which appeared completely prohibitive, the risk of failure was therefore high. This explains the fact that the technology of the invention, targeted at using, in a "microparticulate" system, a crosslinked anionic organic polymer with a size greater than or equal to 1 micron and with a low intrinsic viscosity, has not been employed.

One of the merits of the invention is to have developed a process for the manufacture of paper pulp, according to which there is no specific constraint related to the process for the preparation of the tertiary aid, which is obtained by a conventional dispersion polymerization process requiring no specific precautions with regard to the polymerization conditions.

For marketing reasons, the aim will be to provide the tertiary aid in its most concentrated form possible, preferably in dispersion, well known to a person skilled in the art, this form having the advantage of not requiring the use of large amounts of surfactants.

The tertiary aid is thus produced either as an inverse or "water-in-oil" emulsion or as an aqueous dispersion, also known as an "water-in-water" emulsion.

As already said, the invention is targeted at an improved process which consists in adding, to the suspension or fibrous mass or paper pulp to be flocculated, as main retention agent, at least one cationic polymer, followed by the addition, as a mixture or not as a mixture, of at least one secondary retention aid and at least one crosslinked anionic organic tertiary retention aid different from the secondary aid, with a size of greater than or equal to 1 micron and with a low intrinsic viscosity (less than 3 dl/g).

The additions of the main retention aid and of the secondary and tertiary aids are or not separated by a shearing stage, for example at the mixing pump, known as the fan pump. Reference will be made in this field to the description of Patent U.S. Pat. No. 4,753,710 and to a very large prior art relating to the point of addition of the retention aid with respect to the shearing stages existing on the machine, in particular U.S. Pat. No. 3,052,595, Unbehend, Tappi Vol. 59, No. 10, October 1976, Luner, 1984 Papermakers Conference or Tappi, April 1984, pp. 95-99, Sharpe, Merck and Co. Inc., Rahway, N.J., USA, about 1980, chapter 5, "Polyelectrolyte Retention Aids", Britt, Tappi Vol. 56, October 1973, p. 46 ff., and Waech, Tappi, March 1983, pp. 137, or U.S. Pat. No. 4,388,150.

The process of the invention makes it possible to obtain markedly improved retention, this being the case without an inverse effect. An additional characteristic of this improvement is that the drainage properties are also improved, without having a detrimental affect on the quality of formation of the sheet.

This selection of an anionic organic particle with a size of greater than or equal to 1 micron, with a low intrinsic viscosity and which is crosslinked makes it possible to achieve a level of performance unequalled to date in the papermaking application for total and filler retention and for drainage.

The process of the invention can take on several embodiments.

In a first embodiment, a single secondary retention aid, composed of one or more silica derivatives, advantageously bentonite, is added to the suspension. In this case, the tertiary retention aid is added separately, at the same point or at a separate point, before or after the secondary aid.

In the continuation of the description and in the claims, the expression "a single secondary aid" means that the said aid can comprise several products, provided that they are of the same nature. This is, for example, the case when the secondary aid is composed of one or more silica derivatives.

In a second embodiment, a single secondary retention aid, composed of one or more anionic or amphoteric organic polymers which are different from the tertiary retention aid, is added to the suspension. On such an assumption, the secondary and tertiary retention aids can constitute a mixture, which is then injected at one point. This will generally be the case when the two products exist in compatible physical forms.

In a third embodiment, two secondary retention aids, respectively one or more silica derivatives and one or more anionic or amphoteric organic polymers which are different from the tertiary retention aid, are added to the suspension.

In this case and just as above, essentially for reasons of simplification of the industrial process, when the tertiary aid and one of the secondary aids are in a physical form which renders their mixture compatible, these aids will preferably be used as a mixture. Whatever the solution selected, the object is to reduce the number of injection pumps necessary for the process in order to simplify its implementation.

The main, secondary and tertiary retention aids will now be described in detail.

A) The Main Retention Aid: The Cationic Polymer

Advantageously, in practice, the main cationic retention aid is a cationic polymer based:

on at least one cationic unsaturated ethylenic monomer chosen from the group consisting of monomers of the following types: dialkylaminoalkyl (meth)acrylate, dialkylaminoalkyl(meth)acrylamide, diallylamine, methyldiallylamine and their quaternary ammonium salts or acid salts. Mention will be made in particular of quaternized or salified dimethyl-aminoethyl acrylate (ADAME) and/or dimethylaminoethyl methacrylate (MADAME), dimethyldiallylammonium chloride (DADMAC), acrylamidopropyltrimethylammonium chloride (APTAC) and/or methacrylamidopropyl-trimethylammonium chloride (MAPTAC), optionally on at least one nonionic monomer chosen from the group consisting of acrylamide and/or methacrylamide and/or one of their substituted derivatives and/or N-isopropylacrylamide and/or N,N-dimethylacrylamide and/or N-vinylformamide and/or N-vinylacetamide and/or N-vinylpyrrolidone, optionally on at least one hydrophobic acrylic, allylic or vinyl monomer chosen from the group consisting of acrylamide derivatives, such as N-alkylacrylamides, for example N-(tert-butyl)-acrylamide or octylacrylamide, and N,N-dialkyl-acrylamides, such as N,N-dihexylacrylamide, and/or acrylic acid derivatives, such as alkyl acrylates and methacrylates, optionally on a branching/crosslinking aid.

Optionally, the main retention aid can also be of amphoteric nature by comprising, in combination with the cationic charges, anionic charges carried by anionic monomers, such as, for example, (meth)acrylic acid, acrylamidomethylpropanesulphonic acid, itaconic acid, maleic anhydride, maleic acid, vinylsulphonic acid and their salts.

This polymer does not require the development of a specific polymerization process. It can be obtained by any polymerization technique well known to a person skilled in the art: gel polymerization, precipitation polymerization, (aqueous or inverse) emulsion polymerization, followed or not followed by a distillation and/or spray drying stage, suspension polymerization, solution polymerization, and the like.

The branching and/or crosslinking can be carried out preferably during (or optionally after) the polymerization, in the presence of a branching/crosslinking aid and optionally of a transfer agent. A nonlimiting list of the branching/crosslinking aids will be found below: methylenebisacrylamide (MBA), ethylene glycol diacrylate, polyethylene glycol dimethacrylate, diacrylamide, cyanomethyl acrylate, vinyloxyethyl acrylate or methacrylate, triallylamine, formaldehyde, glyoxal, compounds of glycidyl ether type, such as ethylene glycol diglycidyl ether, or epoxy compounds, or any other means well known to a person skilled in the art which makes crosslinking possible.

In a well known way, optimization of the polymerization conditions (amount of branching/crosslinking aid used, concentration of the active material for the polymerization, polymerization temperature, type and amount of initiators, optional transfer agent) makes it possible to obtain either a branched polymer or a crosslinked polymer, as desired.

In practice, the branching/crosslinking aid is methylenebisacrylamide (MBA), introduced in a proportion of five to ten thousand (5 to 10 000) parts per million by weight, preferably 5 to 1000.

A nonlimiting list of the transfer agents will be found below: isopropyl alcohol, sodium hypophosphite, mercaptoethanol, and the like.

A person skilled in the art will know how to choose the best combination according to his own knowledge and the present description, as well as the examples which will follow.

The cationic polymer is characterized in that it has an IV of greater than 2 dl/g and without a maximum limit.

Advantageously, the amount of cationic polymer introduced into the suspension to be flocculated is between thirty and three thousand grams of active polymer per tonne of dry pulp (30 and 3000 g/t), i.e. between 0.003 percent and 0.3 percent. It was observed that, if the amount is less than 0.003%, no significant retention is obtained. Likewise, if the amount exceeds 0.3%, no significant improvement is observed. Preferably, the amount of main retention aid introduced is between 0.01 and 0.05 percent (0.01 and 0.05%) of the amount of the dry pulp, i.e. between 150 g/t and 500 g/t.

The main retention aid according to the invention is injected or introduced, before an optional shearing stage, into the paper pulp (or fibrous mass to be flocculated), more or less diluted according to the practical experience of a person skilled in the art, and generally into the diluted paper pulp or thin stock, that is to say a pulp diluted to approximately 0.7-1.5% of solid matter, such as cellulose fibres, optional fillers and the various additives conventional in the manufacture of paper.

An alternative form of the invention relates to fractional introduction. A portion of the cationic polymer according to the invention will be introduced at the stage of preparation of the thick pulp or thick stock, comprising approximately 5% or more of solid matter, or even at the preparation of the thick pulp before a shearing stage.

B) The Secondary Retention Aid

These aids preferably comprise, but without a limiting nature, alone or as a mixture:

silica derivatives, such as, for example, particles of silica including bentonites originating from hectorites, smectites, montmorillonites, nontronites, saponites, sauconites, hormites, attapulgites and sepiolites, derivatives of silicate, aluminosilicate or borosilicate type, zeolites, kaolinites, or modified or unmodified colloidal silicas. Secondary aids of this type are preferably introduced immediately upstream of the headbox in a proportion of 0.01 to 0.5 percent (0.01 to 0.5%) by dry weight with respect to the dry weight of the fibrous suspension, crosslinked, branched or linear and anionic or amphoteric organic polymers which are different from the tertiary retention aid. Advantageously, in practice, it relates to a preferably linear (co)polymer of at least one anionic unsaturated ethylenic monomer, chosen from the group consisting of the monomers, such as, for example, (meth)acrylic acid, acrylamidomethylpropanesulphonic acid, itaconic acid, maleic anhydride, maleic acid, vinylsulphonic acid and their salts, which exhibits a UL viscosity of greater than 2, preferably of greater than 4 and without a maximum limit.

Secondary aids of this type are preferably introduced immediately upstream of the headbox in a proportion of 30 to 1000 g/t by weight of active material of the polymer with respect to the dry weight of the paper pulp fibrous suspension, preferably of 30 to 600 g/t.

C) The Tertiary Retention Aid: The Crosslinked Anionic Organic Dispersion with a Size of Greater Than or Equal to 1 Micron and with a Low Intrinsic Viscosity In practice, the tertiary retention aid is an anionic organic polymer, characterized in that it is crosslinked, with a particle size of greater than or equal to 1 micron and with a low intrinsic viscosity of less than 3 dl/g.

More particularly, the invention relates to dispersions of organic polymers comprising anionic units obtained in the form of a dispersion comprising, for example, from 10 to 80% by weight of at least one crosslinked anionic polymer with a particle size of greater than or equal to 1 micron and with a low intrinsic viscosity (less than 3 dl/g).

A person skilled in the art will understand that the term "dispersion" or analogous terms relating to the polymer used according to the invention denotes either a composition comprising a continuous oil phase, an noncontinuous aqueous phase and at least one emulsifier of water-in-oil type or a composition comprising, as continuous phase, a brine (water+salts) and at least one stabilizing agent.

The tertiary retention aids of the present invention are obtained by using, during the polymerization, a crosslinking aid well known to a person skilled in the art, preferably in the absence of a transfer agent.

More specifically, the tertiary retention aids are obtained by polymerization (or respectively copolymerization, together throughout the text and the claims: "polymerization") of at least one anionic monomer and optionally of other nonionic or cationic monomers, in the presence of a crosslinking aid. They have to exhibit an overall anionic charge.

A person skilled in the art will know how to assess, from his own knowledge or using routine tests, the polymerization conditions to be used to obtain a final polymer exhibiting an intrinsic viscosity as required.

Furthermore, it is also possible to concentrate the polymer by any known technique, such as, for example, by azeotropic distillation, precipitation, spray drying, and the like.

According to the present invention, it has been discovered, surprisingly, that a novel family of anionic organic dispersions makes it possible to achieve a level of performance hitherto unequalled for retention and drainage.

According to a preferred embodiment, the copolymer is obtained from:

10-100 mol % of at least one monomer having an anionic charge, 0-90 mol % of at least one monomer having a neutral and/or cationic charge, the polymerization concentration is preferably between 20 and 50%, and a crosslinking aid. Preferably, the level of crosslinking aid is greater than 5 ppm, advantageously 15 ppm.

A nonlimiting list of the monomers which can be used will be found below:

a) anionic unsaturated ethylenic monomers having a carboxyl functional group (for example: acrylic acid, methacrylic acid, and their salts, and the like), having a sulphonic acid functional group (for example: 2-acrylamido-2-methylpropanesulphonic acid (AMPS) and its salts, and the like), and the like, b) nonionic monomers: acrylamide, methacrylamide, N-isopropylacrylamide, N,N-dimethylacrylamide, N-vinylformamide, N-vinylacetamide, N-vinylpyrrolidone, vinyl acetate, acrylate esters, allyl alcohol, and the like, and/or cationic monomers: mention will be made, in particular and without implied limitation, of quaternized or salified dimethylaminoethyl acrylate (ADAME) and/or dimethylaminoethyl methacrylate (MADAME), dimethyldiallylammonium chloride (DADMAC), acrylamidopropyltrimethylammonium chloride (APTAC) and/or methacrylamidopropyltrimethylammonium chloride (MAPTAC).

It is important to note that, in combination with these monomers, it is also possible to use water-insoluble monomers, such as acrylic, allylic or vinyl monomers comprising a hydrophobic group. When they are used, these monomers will be employed in very low amounts, of less than 20 mol %, preferably of less than 10 mol %, and they will preferably be chosen from the group consisting of acrylamide derivatives, such as N-alkylacrylamides, for example N-(tert-butyl)-acrylamide or octylacrylamide, and N,N-dialkyl-acrylamides, such as N,N-dihexylacrylamide, and the like, acrylic acid derivatives, such as alkyl acrylates and methacrylates, and the like.

A nonlimiting list of the crosslinking aids will be found below: methylenebisacrylamide (MBA), ethylene glycol diacrylate, polyethylene glycol dimethacrylate, diacrylamide, cyanomethyl acrylate, vinyloxyethyl acrylate or methacrylate, triallylamine, formaldehyde, glyoxal, compounds of glycidyl ether type, such as ethylene glycol diglycidyl ether, or epoxy compounds, or any other means well known to a person skilled in the art which makes crosslinking possible.

The tertiary retention aid is introduced into the suspension in an entirely preferred way in a proportion of 30 g/t to 1000 g/t by weight of active material (polymer) with respect to the dry weight of the fibrous suspension, preferably of 30 g/t to 600 g/t.

As already indicated above, the polymer particle can be used either in the form of a dispersion, dissolved or "inverted" in water, or in the form of a solution in water of the powder obtained by drying the said dispersion.

In one advantageous embodiment, a coagulant is added to the fibrous suspension prior to the addition of the main retention aid.

As is well known to a person skilled in the art, the use of this type of product makes it possible to improve all the more the performance in retention at dosages (of active principle) of 0.01 to 10 kg/t and preferably between 0.03 and 3 kg/t. Mention will be made in particular, and as examples, of the coagulants chosen from the group consisting of inorganic coagulants, such as polyaluminium chloride (PAC), aluminium sulphate, polyaluminium chlorosulphate, and the like, and organic coagulants, including polymers based on diallydimethylammonium chloride (DADMAC), quaternary polyamines manufactured by condensation of a primary or secondary amine with epichlorohydrin, polymers exhibiting functional groups of vinylamine type or resins of dicyandiamide type, and the like. These coagulants can be used alone or as a mixture and are preferably added as a thick paste.

It will be noted that the addition of the secondary and tertiary retention aids can be carried out in any order of introduction, as or not as a mixture.

The invention also relates to the use of a crosslinked anionic organic polymer with a size of greater than or equal to 1 micron and exhibiting an intrinsic viscosity of less than 3 dl/g, optionally as a mixture with one or more anionic or amphoteric organic polymers different from the said crosslinked anionic organic polymer, as retention aid in a process for the manufacture of paper, board or similar products.

In one specific case, another subject-matter of the invention is a tertiary or secondary retention aid composed of at least one crosslinked anionic organic polymer with a size of greater than or equal to 1 micrometer and exhibiting an intrinsic viscosity of less than 3 dl/g, optionally as a mixture with one or more linear anionic organic polymers.

The following examples illustrate the invention without, however, limiting the scope thereof.

1. Method for Measuring the Particle Size and the Intrinsic Viscosity:

a) Particle sizes were measured using a Horiba device of the LA-900 series by laser light diffraction.

b) Intrinsic viscosity measurements were carried out according to the method as defined in Standard ISO 1628/1, October 1988, "Guidelines for the standardization of methods for the determination of viscosity number and limiting viscosity number of polymers in dilute solution".

c) Measurement of UL viscosity: the UL viscosity is measured using a Brookfield viscometer of LVT type equipped with a UL adapter, the unit of which rotates at 60 revolutions/minute (0.1% by weight of polymer in a 1M saline sodium chloride solution).

d) Measurements of formation:

Table 3: visual evaluation (Frm). Scale of formation of the sheets obtained: 1: excellent, homogeneous; 2: good, closed; 3: moderate, slightly cloudy; 4: bad, cloudy.

Table 6: measurement of the index of formation (LT index) using a 2-dimension look-through meter: the lower the value, the better the formation of the sheet.

2. Presentation of the Polymers

A) The main retention aid: the cationic polymer

In the examples which follow, the following polymers are used:

| Main retention aid | Type | Composition | Cationicity | Presence of crosslinking aid | UL Viscosity | IR |
|---|---|---|---|---|---|---|
| MA1 | (gel polymerization) Powder | AM/ADC | 10 mol % | NO | 4.2 | 3% |
| MA2 | Inverse emulsion | AM/ADC | 10 mol % | YES | 3.5 | 35% |
| MA3 | Water/water emulsion | AM/ADC | 10 mol % | NO | 4.1 | 2% |
| MA4 | Water/water emulsion | AM/ADC | 10 mol % | YES | 3.2 | 38% |
| MA5 | Inverse emulsion | AM/APTAC | 20 mol % | NO | 3.6 | 2% |

With:
AM: acrylamide
ADC: dimethylaminoethyl acrylate quaternized by methyl chloride
APTAC: acrylamidopropyltrimethylammonium chloride
Branching/crosslinking aid: methylenebisacrylamide
Ionic regain: IR = ((X − Y)/Y) × 100 with X: ionicity after shearing in meq/g Y: ionicity before shearing in meq/g.

B) The Tertiary Retention Aid: the Crosslinked Anionic Organic Polymer Dispersion With the exception of E3, all the particles were prepared by the inverse emulsion polymerization technique based on 30 mol % of acrylamide and 70 mol % of ammonium acrylate.

| Particles | Crosslinking aid: MBA (ppm by weight) | Transfer aid: Hypophosphite (ppm by weight) | Particle diameter (microns) | Intrinsic viscosity |
|---|---|---|---|---|
| E1 | 50 | 0 | 1.0 | 2.5 |
| X2 | 50 | 0 | 0.7 | 2.3 |
| E3* | 50 | 0 | 5 | 2.8 |
| E4 | 100 | 0 | 1.1 | 2.2 |
| E5 | 10 | 0 | 1.0 | 2.9 |
| E6 | 200 | 10 | 1.2 | 2.1 |
| X7 | Crosslinked anionic organic particle sold by Ciba under the trade name Polyflex CP3 | | 0.2 | 1.8 |
| E8 | 5 | 0 | 1.0 | 2.5 |
| X9 | 50 | 0 | 1.1 | 3.5 |
| X10 | 0 | 100 | 1.3 | 2.8 |
| X11 | 5 | 10 | 1.2 | 10 |

*E3 is produced in aqueous dispersion ("oil-in-water" emulsion) 50 mol % of acrylamide and 50 mol % of acrylic acid.

The E examples relate to the tertiary retention aids of the invention. The X examples are counterexamples.

3. Test Procedure for the Emulsions

The various tests were carried out in a container of "Britt Jar" type and with a pulp consisting of a mixture of:

70% of bleached hardwood kraft

10% of bleached softwood kraft

20% of mechanical pulp

20% of natural calcium carbonate.

sizing in a neutral medium with 2% of an alkyl ketene dimer emulsion.

The pulp used is diluted to a consistency of 1.5%. 2.24 g on a dry basis of pulp, i.e. 149 g of 1.5% pulp, are withdrawn and are then diluted to 0.4% with clear water. A volume of 560 ml of this diluted pulp is introduced into the plexiglass cylinder of the automated handsheet former and the sequence is begun.

Britt Jar sequence at 1000 rpm (revolutions per minute):

T=0 s: Optional addition of the coagulant

T=70 s: Addition of the main retention aid

T=80 s: Addition of the secondary retention aid

T=85 s: Addition of the tertiary retention aid

T=90 s: Removal of the first 20 ml, corresponding to the dead volume, then sampling of exactly 100 ml for filtration for the Britt Jar test.

The following analyses are then carried out:

% FPAR: first pass ash retention as percentage

% FPR: first pass retention as percentage (total retention)

CSF: measurement of the degree of drainability of the pulp (Standard Tappi T 227OM-94).

For each of these analyses, the highest values correspond to the best performances.

4. Results

TABLE 1

Comparative study on various retention systems

| No. | | Main retention aid | Retention aid(s) secondary | Retention aid(s) tertiary | Respective dosage (kg/t) | % FPAR | % FPR | CSF |
|---|---|---|---|---|---|---|---|---|
| 0 | | Blank | | | — | 0.00 | 70.05 | 421 |
| 1 | — | MA1 | — | — | 0.3 | 31.80 | 78.37 | 430 |
| 2 | — | MA1 | bentonite | — | 0.3/2 | 46.74 | 81.46 | 451 |

TABLE 1-continued

| Comparative study on various retention systems | | | | | | | | |
|---|---|---|---|---|---|---|---|---|
| | | Main retention | Retention aid(s) | | Respective dosage | % | % | |
| No. | | aid | secondary | tertiary | (kg/t) | FPAR | FPR | CSF |
| 3 | — | MA1 | colloidal silica | — | 0.3/2 | 34.94 | 78.39 | 443 |
| 4 | — | MA1 | X7 | — | 0.3/0.4 | 40.46 | 78.80 | 422 |
| 5 | — | MA1 | bentonite | X7 | 0.3/2/0.4 | 57.70 | 82.80 | 471 |
| 6 | — | MA1 | bentonite | E8 | 0.3/2/0.4 | 60.50 | 83.00 | 479 |
| 7 | — | MA1 | bentonite | X9 | 0.3/2/0.4 | 59.71 | 79.91 | 473 |
| 8 | — | MA1 | bentonite | E1 | 0.3/2/0.4 | 66.06 | 84.18 | 492 |
| 9 | — | MA1 | colloidal silica | E1 | 0.3/2/0.4 | 56.72 | 82.08 | 457 |
| 10 | — | MA1 | X7 | E1 | 0.3/0.4/0.4 | 65.41 | 84.25 | 463 |
| 11 | coagulant | MA1 | bentonite | E1 | 1/0.3/2/0.4 | 85.49 | 91.45 | 611 |
| 12 | — | MA1 | (LP + E1) added as a mixture (90/10) | | 0.3/0.4 | 85.89 | 91.54 | 550 |
| 13 | coagulant | MA1 | (LP + E1) added as a mixture (90/10) | | 0.3/0.4 | 90.23 | 94.12 | 577 |

LP: linear anionic copolymer (30 mol % sodium acrylate, 70 mol % acrylamide): UL viscosity: 8.2 (IV = 25).

The coagulant used in Table 1 is a polyaluminium chloride (dosage: 1 kg/t).

Comments on the Results:

For a given main retention aid, the use in combination with a secondary retention aid of a tertiary retention aid of the invention overall and significantly improves the efficiency of the process for the manufacture of the paper, with regard to retention and drainage.

It is found in particular that:

the combination of a tertiary aid of the invention with bentonite (Test 8/Test 2, 5, 6 and 7) makes it possible to obtain hitherto unequalled performances, likewise, the combination of a tertiary aid of the invention with a colloidal silica (9/3) or with an organic microparticle, such as Polyflex CP3 (10/4), results in higher levels of retention and drainage than comparable systems.

Tests 5, 6, 7 and 8 demonstrate the essential role played by the criteria of dispersion size and of intrinsic viscosity.

TABLE 2

| Comparative study related to the nature of the tertiary retention aids | | | | | | | |
|---|---|---|---|---|---|---|---|
| | Main reten-tion | Retention aid(s) | | Respective dosage | % | % | |
| No. | aid | secondary | tertiary | (kg/t) | FPAR | FPR | CSF |
| 8 | MA1 | bentonite | E1 | 0.3/2/0.4 | 66.06 | 84.18 | 492 |
| 14 | MA1 | bentonite | E3 | 0.3/2/0.4 | 61.36 | 83.77 | 479 |
| 15 | MA1 | bentonite | E4 | 0.3/2/0.4 | 62.83 | 83.89 | 485 |
| 16 | MA1 | bentonite | E5 | 0.3/2/0.4 | 61.52 | 81.99 | 479 |
| 17 | MA1 | bentonite | E6 | 0.3/2/0.4 | 63.02 | 83.97 | 487 |
| 18 | MA1 | bentonite | X2 | 0.3/2/0.4 | 60.14 | 82.78 | 476 |
| 5 | MA1 | bentonite | X7 | 0.3/2/0.4 | 57.70 | 82.80 | 471 |
| 6 | MA1 | bentonite | E8 | 0.3/2/0.4 | 60.50 | 83.00 | 479 |
| 7 | MA1 | bentonite | X9 | 0.3/2/0.4 | 59.71 | 79.91 | 473 |
| 19 | MA1 | bentonite | X10 | 0.3/2/0.4 | 53.21 | 79.31 | 452 |

Comments on the Results

The tests show that the performance of the particles cannot be correlated with their size, which runs counter to the knowledge and expectations of a person skilled in the art. Only the particles according to the invention, which simultaneously combine a size of greater than 1 micron, a degree of crosslinking and an intrinsic viscosity of less than 3, make it possible to exhibit a greater efficiency with regard to the total retention and to the filler retention and to the drainage.

TABLE 3

| Comparative study related to the dosage of the secondary retention aids | | | | | | | | |
|---|---|---|---|---|---|---|---|---|
| | Main retention | Retention aid(s) | | Respective dosage | | | | |
| No. | aid | secondary | tertiary | (kg/t) | % FPAR | % FPR | CSF | Frm |
| 0 | | Blank | | — | 0.00 | 70.05 | 421 | 1 |
| 2 | MA1 | bentonite | — | 0.3/2 | 46.74 | 81.46 | 452 | 3 |
| 8 | MA1 | bentonite | E1 | 0.3/2/0.4 | 66.06 | 84.18 | 492 | 3 |
| 20 | MA1 | bentonite | E1 | 0.3/1/0.4 | 62.24 | 84.17 | 485 | 2 |

TABLE 3-continued

| Comparative study related to the dosage of the secondary retention aids | | | | | | | | |
|---|---|---|---|---|---|---|---|---|
| | Main retention | Retention aid(s) | | Respective dosage | | | | |
| No. | aid | secondary | tertiary | (kg/t) | % FPAR | % FPR | CSF | Frm |
| 21 | MA1 | bentonite | E1 | 0.3/2/0.2 | 58.94 | 82.47 | 473 | 3 |
| 22 | MA1 | bentonite | E1 | 0.3/1/0.2 | 65.96 | 83.91 | 486 | 1 |

Comments on the Results:

The use of an organic dispersion according to the invention as tertiary retention aid makes it possible to reduce the dosage of the secondary retention aid without affecting the performance of the process.

Furthermore, and in an entirely surprising way, the formation of the sheet is not detrimentally affected and is even in some cases improved by the use of a tertiary aid of the invention, this being the case despite an enhancement in the drainage performance (which generally takes place at the expense of the formation of the sheet).

TABLE 4

| Comparative study related to the nature of the main retention aid | | | | | | | |
|---|---|---|---|---|---|---|---|
| | Main retention | Retention aid(s) | | Respective dosage | % | % | |
| No. | aid | secondary | tertiary | (kg/t) | FPAR | FPR | CSF |
| 8 | MA1 | bentonite | E1 | 0.3/2/0.4 | 66.06 | 84.18 | 492 |
| 23 | MA2 | bentonite | E1 | 0.3/2/0.4 | 70.17 | 85.73 | 494 |
| 24 | MA3 | bentonite | E1 | 0.3/2/0.4 | 65.10 | 84.03 | 489 |
| 25 | MA4 | bentonite | E1 | 0.3/2/0.4 | 69.97 | 85.59 | 493 |
| 26 | MA2 | colloidal silica | E1 | 0.3/2/0.4 | 57.18 | 80.36 | 454 |

TABLE 4-continued

| Comparative study related to the nature of the main retention aid | | | | | | | |
|---|---|---|---|---|---|---|---|
| | Main retention | Retention aid(s) | | Respective dosage | % | % | |
| No. | aid | secondary | tertiary | (kg/t) | FPAR | FPR | CSF |
| 27 | MA3 | colloidal silica | E1 | 0.3/2/0.4 | 54.25 | 79.87 | 450 |
| 28 | MA4 | colloidal silica | E1 | 0.3/2/0.4 | 56.77 | 80.04 | 457 |
| 29 | MA4 | X7 | E1 | 0.3/2/0.4 | 67.18 | 83.27 | 465 |
| 30 | MA5 | E1 | bentonite | 0.3/2/0.4 | 69.92 | 85.18 | 487 |

Comments on the Results:

The organic particle according to the invention used as tertiary retention aid is not significantly affected by the nature of the main retention aid (8, 21-23; 24-26; 27). The order of introduction of the secondary and tertiary retention aids is not a distinguishing criterion either (28).

In conclusion, despite a low intrinsic viscosity and a high particle size, of greater than 1 micron, it is found that, in combination with another secondary retention aid, the combination according to the invention introduces a net gain with regard to filler retention and with regard to total retention and proves to be superior to the pre-existing systems.

TABLE 5

| Comparative study related to the nature of the coagulant | | | | | | | |
|---|---|---|---|---|---|---|---|
| | | Main retention | Retention aid(s) | | Respective dosage | % | % |
| No. | Coagulant | aid | secondary | tertiary | (kg/t) | FPAR | FPR |
| 31 | — | MA1 | bentonite | E1 | 0.3/1/0.3 | 63.27 | 83.79 |
| 32 | Polyamine* | MA1 | bentonite | E1 | 0.4/0.3/1/0.3 | 85.04 | 91.50 |
| 33 | PolyDADMAC# | MA1 | bentonite | E1 | 0.4/0.3/1/0.3 | 85.51 | 90.52 |
| 34 | Polyamine* + PAC (50/50) | MA1 | bentonite | E1 | 0.4/0.3/1/0.3 | 86.91 | 90.66 |
| 35 | PolyDADMAC# + PAC (50/50) | MA1 | bentonite | E1 | 0.4/0.3/1/0.3 | 86.25 | 89.57 |
| 36 | PAC | MA1 | bentonite | E1 | 0.4/0.3/1/0.3 | 82.99 | 88.54 |
| 37 | Polyvinylamine | MA1 | bentonite | E1 | 0.4/0.3/1/0.3 | 87.02 | 92.27 |

*epichlorohydrin + dimethylamine resin

#DADMAC homopolymer

Comments on the Results:

For a given retention system of the invention, the use of a coagulant overall and significantly improves the efficiency of the process for the manufacture of the paper.

TABLE 6

Comparative study related to the use of several secondary aids

| No. | Main retention aid | Retention aid(s) secondary | Retention aid(s) tertiary | Respective dosage (kg/t) | % FPAR | % FPR | Frm |
|---|---|---|---|---|---|---|---|
| 0 | | Blank | | — | 0.00 | 70.05 | 175.9 |
| 38 | MA1 | bentonite | E1 | 0.3/2/0.3 | 64.31 | 84.02 | 190.5 |
| 39 | MA1 | bentonite | X7 | 0.3/2/0.3 | 53.12 | 81.67 | 193.2 |
| 40 | MA1 | bentonite | X11 | 0.3/1/0.3 | 56.07 | 82.17 | 230.3 |
| 41 | MA1 | (bentonite + LP) | E1 | 0.3/2-0.27/0.03 | 86.39 | 91.01 | 209.2 |
| 42 | MA1 | bentonite | (LP + E1) (80/20) | 0.3/1/0.3 | 87.11 | 91.44 | 211.6 |
| 43 | MA1 | bentonite | (LP + E1) (10/90) | 0.3/1/0.3 | 75.23 | 86.45 | 196.7 |

It is found that:

only the use of the polymers of the invention makes it possible to simultaneously obtain a high performance both with regard to retention and with regard to formation, the combination of the crosslinked polymers of the invention with a second secondary retention aid of linear anionic polymer type, in addition to the bentonite, makes possible a significant improvement in the retention in return simply for a very limited and industrially acceptable deterioration in the formation of the sheet.

This makes it possible to provide a multicomponent retention system which is flexible and adjustable to the objectives of the paper manufacturer (productive output and production quality performances).

It should be noted that the branched polymer (Test 40) used as tertiary aid exhibits, as indisputably demonstrated in the preamble of this application, different characteristics from those of a linear polymer+crosslinked polymer blend and gives poorer results.

The invention claimed is:

1. Process for the manufacture of paper or board, comprising:

adding, to a paper pulp fibrous suspension, at least one main retention aid composed of a cationic (co)polymer, resulting in the formation of flocs in the suspension;

optionally shearing the flocs; and adding to the suspension, separately or as a mixture, in any order:

at least one secondary retention aid chosen from the group consisting of silica derivatives and anionic or amphoteric organic polymers, and at least one tertiary retention aid composed of a crosslinked anionic organic polymer having a particle size of greater than or equal to 1 micrometer and exhibiting an intrinsic viscosity of less than 3 dl/g;

wherein the one or more anionic or amphoteric organic polymers that are contained in the secondary retention aid differ from the crosslinked anionic organic polymer of the tertiary retention aid.

2. Process according to claim 1, wherein the secondary retention aid is composed of one or more silica derivatives.

3. Process according to claim 1, wherein two secondary retention aids, one or more silica derivatives and one or more anionic or amphoteric organic polymers, respectively, that are different from the tertiary retention aid are added to the suspension.

4. Process according to claim 3 wherein said one or more anionic or amphoteric organic polymers that are contained in the secondary retention aid comprises a linear anionic organic polymer.

5. Process according to claim 4, wherein the linear anionic organic polymer is a (co)polymer of at least one anionic unsaturated ethylenic monomer, chosen from the group consisting of the monomersof (meth)acrylic acid, acrylamidomethylpropanesulphonic acid, itaconic acid, maleic anhydride, maleic acid, vinylsulphonic acid and their salts, which exhibits a UL (Underwriters Laboratories) viscosity of greater than 2.

6. Process according claim 1, wherein the anionic or amphoteric organic polymers are injected as a mixture with the tertiary retention aid.

7. Process according to claim 1, wherein:

the tertiary retention aid comprises a dispersion and is introduced into the paper pulp fibrous suspension at a concentration of 30 to 1000 g/t by weight of said crosslinked anionic organic polymer with respect to the dry weight of the paper pulp fibrous suspension, and:

the secondary retention aid is:

a silica derivative chosen from the group consisting of particles of silica including bentonites originating from hectorites, smectites, montmorillonites, nontronites, saponites, sauconites, hormites, attapulgites and sepiolites, derivatives of silicate, aluminosilicate or borosilicate type, zeolites, kaolinites, and modified or unmodified colloidal silicas, introduced in a proportion of 0.01 to 0.5 per cent (0.01 to 0.5%) by dry weight with respect to the dry weight of the fibrous suspension, and/or an anionic or amphoteric organic polymer introduced in a proportion of 30 to 1000 g/t with respect to the dry weight of the fibrous suspension.

8. The process according to claim 7, wherein said concentration is 30 to 600 g/t of the crosslinked anionic organic polymer of the tertiary retention aid with respect to the dry weight of the paper pulp fibrous suspension; and wherein the proportion by weight of the ionic or amphoteric organic polymer of the secondary retention aid with respect to the dry weight of the fibrous suspension is 30 to 600 g/t.

9. Process according to claim 1, wherein the main retention aid is a cationic polymer formed from at least one cationic unsaturated ethylenic monomer chosen from the group consisting of dialkylaminoalkyl (meth)acrylates, dialkylaminoalkyl(meth)acrylamides, diallylamines, methyldiallylamines and their quaternary ammonium salts or acid salts.

10. The process according to claim 9, wherein the cationic polymer further includes at least one monomer chosen from the group consisting of acrylamide, methacrylamide, N isopropylacrylamide, N,N dimethylacrylamide, N-vinylformamide, N-vinylacetamide, N- vinylpyrrolidone, (meth)acrylic acid, acrylamidomethylpropanesulphonic acid, itaconic acid, maleic anhydride, maleic acid, vinylsulphonic acid and their salts, and combinations thereof;

a hydrophobic acrylic, allylic or vinyl monomer, and combinations thereof; and wherein said cationic polymer optionally further includes a branching/crosslinking aid.

11. Process according to claim 1, wherein the main retention aid has an IV (intrinsic viscosity) of greater than 2 dl/g.

12. Process according to claim 1, wherein the tertiary retention aid is a polymer formed from at least one anionic unsaturated ethylenic monomer chosen from the group consisting of monomers having a carboxyl functional group and their salts, and/or monomers having a sulfonic acid functional group and their salts, said polymer being crosslinked by a crosslinking aid.

13. Process according to claim 12,wherein the crosslinking aid is chosen from the group consisting of methylenebisacrylamide (MBA), ethylene glycol diacrylate, polyethylene glycol dimethacrylate, diacrylamide, cyanomethyl acrylate, vinyloxyethyl acrylate or methacrylate, triallylamine, formaldehyde, glyoxal, glycidyl ethers, and epoxy compounds.

14. Process according to claim 12,wherein the crosslinking aid is methylenebisacrylamide (MBA) and is introduced at a concentration of greater than or equal to 5 ppm (parts per million) by weight of monomers.

15. The process according to claim 14, wherein the methylenebisacrylamide (MBA) is introduced at a concentration of greater than or equal to 15 ppm.

16. The process according to claim 12, wherein the tertiary retention aid further includes at least one nonionic monomer chosen from the group consisting of acrylamide, methacrylamide, N-isopropylacrylamide, N,N-dimethylacrylamide, N-vinylformamide, N-vinylacetamide, N- vinylpyrrolidone, and combinations thereof.

17. Process according to claim 1, wherein the secondary retention aid is a semi-sodium bentonite used in a proportion of 0.1 to 0.5% by dry weight with respect to the dry weight of the fibrous suspension.

18. Process according to claim 1, wherein the amount of added main cationic (co)polymer retention aid is between 0.003 and 0.3% by weight of the dry weight of the fibrous suspension.

19. The process according to claim 18, wherein the amount of added main cationic (co)polymer retention aid is between 0.01 and 0.05% by weight with respect to the dry weight of the fibrous suspension.

20. Process according to claim 1, further comprising adding a coagulant to the suspension prior to the addition of the main retention aid.

21. Process according to claim 20, wherein the coagulant is chosen from the group consisting of polyaluminium chloride (PAC), aluminium sulphate, polyaluminium chlorosulphate, polymers based on diallyldimethylammonium chloride (DADMAC), quaternary polyamines manufactured by condensation of a primary or secondary amine with epichlorohydrin, polymers containing vinylamine groups, and dicyandiamide resins.

* * * * *